US005788091A

United States Patent [19]

Robertson et al.

[11] Patent Number: 5,788,091

[45] Date of Patent: Aug. 4, 1998

[54] ARTICLE-DISPENSING SYSTEM HAVING AN ATTRACTION DEVICE

[75] Inventors: James D. Robertson; Jonathan M. Wood, both of Atlanta, Ga.; Maynard R. Johnson, Ballwin, Mo.

[73] Assignee: The Mead Corporation, Dayton, Ohio

[21] Appl. No.: 766,268

[22] Filed: Dec. 13, 1996

Related U.S. Application Data

[63] Continuation of Ser. No. 602,652, Feb. 16, 1996, abandoned.

[51] Int. Cl.[6] ..... A47F 7/00

[52] U.S. Cl. ..... 211/59.2; 211/74; 312/45; 40/427

[58] Field of Search ..... 211/59.2, 59.3, 211/74; 312/42, 45, 72; 248/312; 40/427

[56] References Cited

U.S. PATENT DOCUMENTS

| | | | |
|---|---|---|---|
| 4,239,099 | 12/1980 | Williams et al. | 193/32 |
| 4,303,162 | 12/1981 | Suttles | 211/59.3 |
| 4,314,648 | 2/1982 | Spamer | 211/59.2 |
| 4,318,485 | 3/1982 | Clement | 211/59.2 |
| 4,367,818 | 1/1983 | Suttles | 211/59.2 |
| 4,401,221 | 8/1983 | Suttles | 211/59.2 |
| 4,496,037 | 1/1985 | Spamer | 193/2 R |
| 4,690,287 | 9/1987 | Fershko et al. | 211/49.1 |
| 4,730,741 | 3/1988 | Jackle, III et al. | 211/59.3 |
| 4,762,236 | 8/1988 | Jackle, III et al. | 211/59.3 |
| 4,898,262 | 2/1990 | Hawkinson et al. | 211/49.1 |
| 5,069,349 | 12/1991 | Wear et al. | 211/59.3 |
| 5,111,942 | 5/1992 | Bernardin | 211/59.3 |
| 5,201,429 | 4/1993 | Hikosaka et al. | 211/59.2 |
| 5,405,023 | 4/1995 | Murakami | 211/59.2 |

*Primary Examiner*—Robert W. Gibson, Jr.
*Attorney, Agent, or Firm*—Tsugihiko Suzuki

[57] ABSTRACT

The merchandising device includes an elongate track that defines a pathway extending therealong to support a row of articles, an arrangement for feeding the articles toward the front end of the track as leading articles in the row are successively removed one by one from the pathway, a stopper provided at the front end of the track, an attraction device for performing an attention-attracting activity, and a sensor for detecting movement of the articles in the row. The articles when supported by the track are movable along the pathway and are removable therefrom via the front end of the pathway. The stopper engages the leading articles so that all the articles in the row are prevented from being accidentally removed via the front end of the track. Due to the stopper, the leading articles are stopped and presented for removal from the pathway when arriving at the front end of the track. The sensor is electrically connected to the attraction device so as to trigger the activity of the attraction device upon detection of movement of the articles.

17 Claims, 8 Drawing Sheets

ARTICLE-DISPENSING SYSTEM HAVING AN ATTRACTION DEVICE

This is a continuation of Ser. No. 08/602,652 filed Feb. 16, 1996, abandoned.

BACKGROUND OF THE INVENTION

This invention relates to merchandising devices for displaying and dispensing articles such as cans, bottles, bricks and the like, and particularly to a forward feed display device having an attraction device incorporated therein, in which articles are movably supported on a track for display and carried forward on the track by gravity or spring load and the attraction device is activated by movement of the articles.

Forward feed article display devices either of the suspension type or of the chute type have been used in the merchandising of cans and bottles. The suspension type devices are used typically to display soft drink bottles such as PET bottles while suspending the bottles by their annular neck flanges. These devices include elongate tracks each having a pair of parallel rails for slidably receiving therebetween the necks of bottles in a row. The tracks are normally inclined downwardly toward their front ends and thus the suspended bottles are allowed to gravity feed one after another to the respective front ends of the tracks as the leading or foremost bottles in each row are removed successively from the tracks through their front ends. Conventional gravity feed display devices of the type described above are disclosed, for example, in U.S. Pat. Nos. 4,318,485; 4,367,818; and 4,401,221 which are owned by the assignee of the present invention.

The chute type devices can be used to display not only bottled products but also canned or packaged products while slidably supporting such products on channel-shaped tracks. These tracks receives articles such as PET bottles in rows and feed them forward along the tracks either by gravity or by spring load as the leading articles in each row are removed successively from the tracks. Conventional gravity feed chute-type devices are disclosed, for example, in U.S. Pat. Nos. 4,239,099; 4,314,648; 4,496,037; and 4,690,287 which are owned by the assignee of the present invention. Conventional spring-loaded chute-type devices are disclosed, for example, in U.S. Pat. Nos. 4,303,162; 4,730,741; 4,762,236; 4,898,282; 5,069,349; and 5,111,942.

SUMMARY OF THE INVENTION

The present invention provides a forward feed merchandising device incorporating with an attraction device such as a sound generator, a light emitter, a scent emitter, a mechanical movement device and/or the like. According to the invention, the attraction device is triggered by movement of the articles on the track and performs an attention attracting activity such as a pre-recorded music play, a mini flashing light show, a scent emission service, a mechanical puppet show or the like.

The merchandising device of the invention includes an elongate track that defines a pathway extending therealong to support a row of articles, an arrangement for feeding the articles toward the front end of the track as leading articles in the row are successively removed one by one from the pathway, a stopper provided at the front end of the track, an attraction device for performing an attention-attracting activity, and a sensor for detecting movement of the articles in the row. The articles when supported by the track are movable along the pathway and are removable therefrom via the front end of the pathway. The stopper engages the leading articles so that all the articles in the row are prevented from being accidentally removed via the front end of the track. Because of the stopper, the leading articles are stopped and presented for removal from the pathway when arriving at the front end of the track. The sensor is electrically connected to the attraction device so as to trigger the activity of the attraction device upon detection of movement of the articles.

According to a preferred embodiment of the invention, the sensor is mounted on the track at a position adjacent the front end so as to detect movement of the leading articles. This arrangement allows the attraction device to be activated when the sensor detects removal of the leading articles from the pathway.

One preferred form of the sensor is a mechanical switch arranged to be operated by movement of the articles. The switch may be operated directly by the leading articles. In other words, the switch may be pressed and turned off by the leading articles upon their arrival at the front end and may be released and turned on by the leading articles upon their removal from the pathway.

Alternatively, the switch may be operated indirectly by the leading articles. For example, the switch may be operated by a gate mechanism that may be incorporated into the merchandising device according to the invention. The gate mechanism is arranged to block the pathway in response to arrival of the leading articles at the front end and to unblock the pathway in response to removal of the leading articles from the pathway. The blocking by the gate mechanism stops forward movement of the articles in the row other than the leading articles. The switch may be operated by the gate mechanism such that the switch is turned off in response to blocking action of the gate mechanism and is turned on in response to unblocking action of the gate mechanism.

Other preferred forms of the sensor include, but are not limited to, an optical sensor and a motion sensor.

According to the present invention, the merchandising device may be either of a gravity feed type or of a spring-loaded type.

The gravity feed type device according to the invention may have the feeding arrangement in the form of a support structure. The track is supported by the structure such that it is inclined downwardly toward the front end whereby the articles are allowed to gravity feed toward the front end as the leading articles are removed successively from the pathway.

The spring-loaded type device according to the invention may have the feeding arrangement in the form of a combination of a pusher and a spring. The pusher is movably connected to the track for movement along the pathway and is engaged at its front side with the rearmost article in the row. The spring is connected to the track to urge the pusher toward the front end of the track. The strength of the spring may be such that the spring exerts sufficient force throughout the range of movement of the pusher to move all the articles between the pusher and the front end of the track until the leading article on the track reaches to the front end.

According to the present invention, the merchandising device may be either of a suspension type or of a chute type.

The suspension type device according to the invention may have the track with a pair of parallel rails extending along the pathway for suspending bottles by their neck flanges. The rails are spaced apart to receive therebetween the necks of the bottles such that the bottles are slidably engaged at underside of the neck flanges with the rails.

The chute-type device according to the invention may have the track that includes a floor and a pair of spaced parallel side walls. Articles are positioned on the floor for movement along the pathway defined by the floor and the side walls. The side walls are upstanding from the floor in such a manner that a channel structure having a U-shaped cross section is created. The stopper in this type of device may be a front wall upstanding from the floor at the front end of the track.

The objects and advantages of the present invention will be apparent from the following description, the accompanying drawings and the appended claims.

DETAILED DESCRIPTION OF THE PREFERRED EMBODIMENTS

FIGS. 1 to 4 illustrate a suspension type gravity feed merchandising device according to the invention. This device includes one or more bottle display units of the kind shown in FIG. 1 removably mounted on a rack. The rack can be a conventional four-post rack or alternatively a gondola rack consisting of a base having a vertically extending back wall on which the unit-supporting arms are cantilevered. Each device may have only one display unit; however, it will in general have two or more display units arranged one above another.

Figure 1:
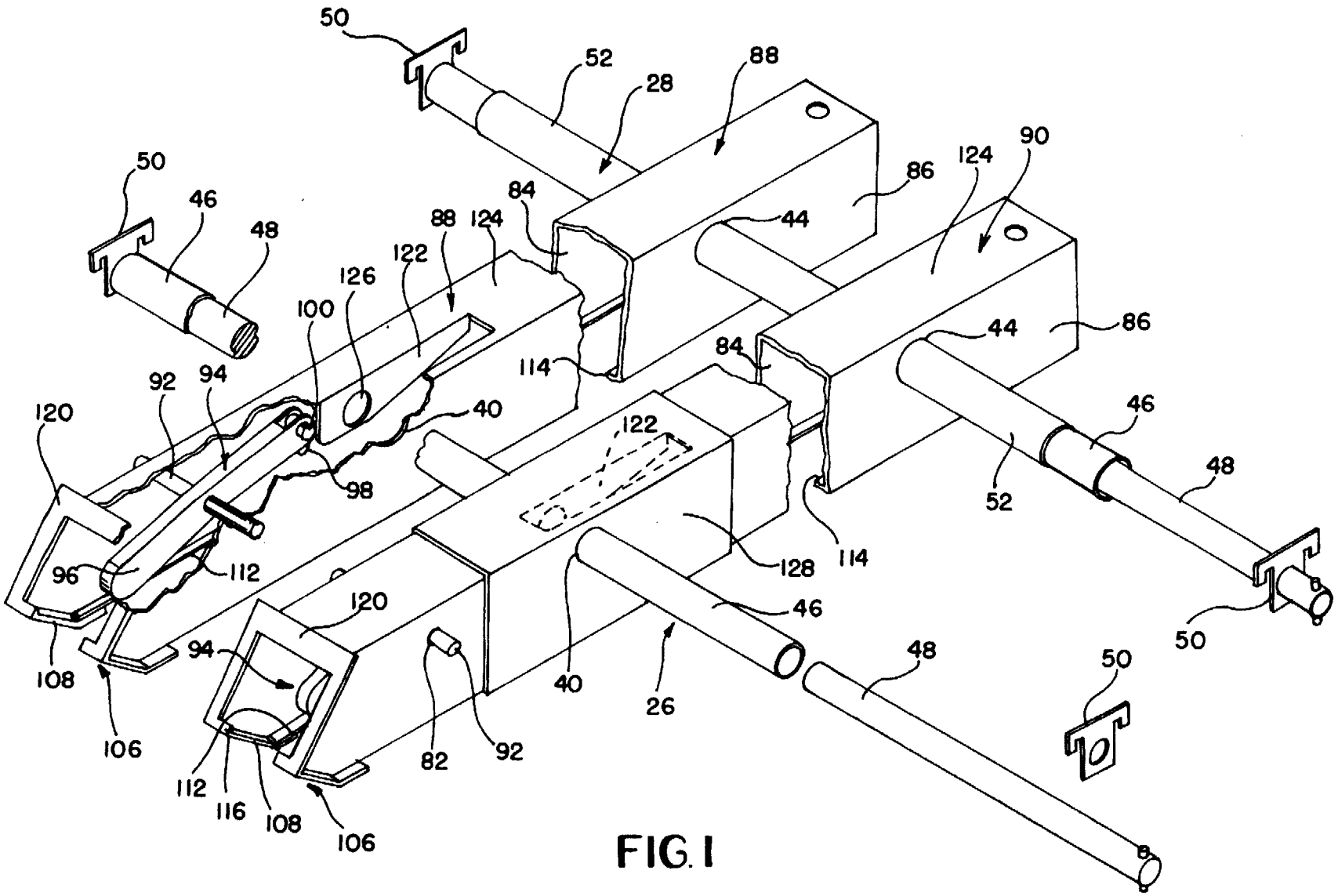
FIG. 1 is a perspective view, partially cutaway, of a display unit of a merchandising device according to the invention.
Figure 2:
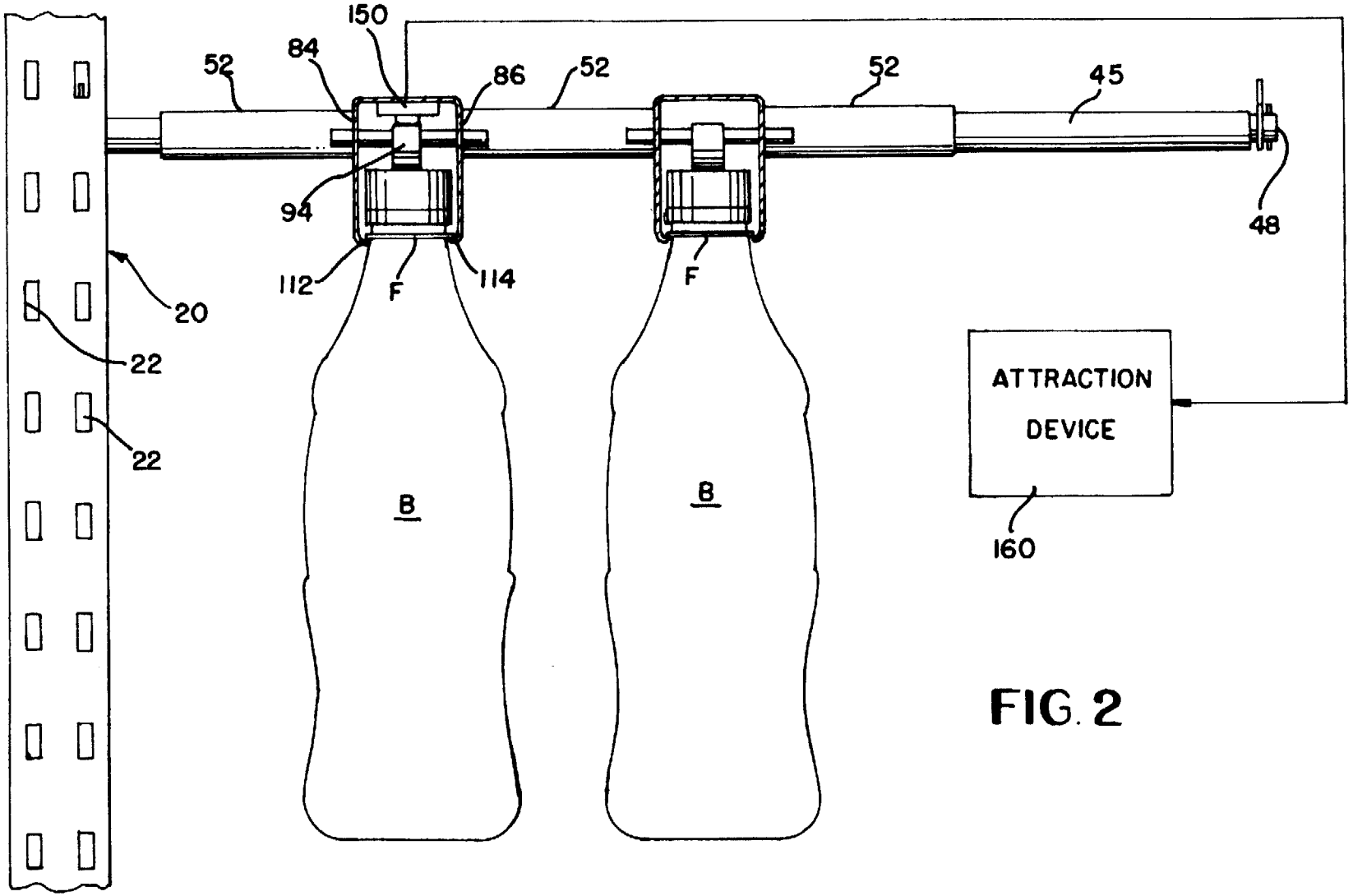
FIG. 2 is a front view of the display unit in FIG. 1, showing bottles held at their neck flanges by the tracks and hanging from the respective front ends of the tracks.

The display unit in FIG. 1 is designed for use preferably on a four-post rack (only partially shown in FIG. 2) having four upright corner posts, i.e., a pair of front posts and a pair of rear posts, connected together by horizontal members of a suitable number. The four corner posts are of a substantially identical structure having a number of engaging openings arranged vertically along the side wall of the respective corner post. An example of such a corner post is shown in FIG. 2 at reference numeral 20. The post 20 is one of the front corner posts and is shown as having two vertical rows of openings 22. However, one vertical row of openings in each corner post may be sufficient in most of the cases wherein the post is used as a vertical support for the display units.

The display unit in FIG. 1 has a plurality of substantially parallel elongate tracks 88 and 90 interconnected through a pair of front and rear transverse support members 26 and 28. The tracks 88 and 90 are virtually identical to each other, and so are the front and rear transverse members 26 and 28. Accordingly, the details will hereinafter be described regarding only the track 88 and the transverse member 26. Those portions of the track 90 identical to the track 99 are identified by the same reference numerals and those of the member 28 identical to the member 26 are denoted by the same reference numerals.

The track 88 is formed preferably of a metal plate or a molded plastic and has a pair of longitudinally extending opposed side walls 84 and 86 joined together along their upper edges by a top wall 124. The side walls 84 and 86 and the top wall 124 in cooperation form a channel structure having an inverted U-shaped cross section. A pair of parallel rails 112 and 114 as best shown in FIG. 2 are joined respectively along the lower edges of the side walls 84 and 86 so as to project inwardly of the track 88 toward each other. A space is maintained between the rails 112 and 114 to receive therein the necks of flanged bottles. The distance between the rails 112 and 114 are such that when bottle necks are received between the rails 112 and 114, the bottles are automatically arranged in a row and the undersides of the neck flanges engage the rails 112 and 114 to allow the bottles to be suspended for sliding movement along the track 88.

Typical flanged bottles used with the device of the invention may be soft drink bottles formed of plastic such as PET and having an integrally formed outwardly projecting annular flanges at their necks immediately under their caps. The manner in which flanged bottles are suspended by their neck flanges is best shown in FIG. 2 wherein the bottles are designated at "B" and the bottle neck flanges are designated at "F". The bottles suspended and arranged in a row gravity feed one after another to the front end of the track 88 as the leading bottles in the row successively are removed from the track 88 through the front end, which will be described in more details later.

The side walls 84 and 86 of the track 88 are provided at near the track front end with a pair of opposed circular apertures 40 (only one shown in FIG. 1) and at near the track rear end with a pair of opposed apertures 44 (only one shown in FIG. 1). The apertures 40 are identical in diameter and receive the front transverse member 26 so that the front portion of the track 88 is supported by the member 26. The diameter of the apertures 40 is such that it allows the track 88 to slide along the member 26. The apertures 44 are of the same size and receive the rear transverse member 28 so that the rear portion of the track 88 is supported by the member 28. The apertures 44 also allow the track 88 to slide along the member 28.

The front transverse member 26 is formed preferably of metal. It extends between the front corner posts such as at 20 and is supported at its opposite ends by the front corner posts. The transverse member 26 includes an outer round tube 46 having an outer diameter slightly less than the apertures 40 and a pair of inner round rods 48 (only one shown in FIGS. 1 and 2) respectively received telescopingly or slidably in the opposite end portions of the outer tube 46. This telescopic structure provides flexibility in length of the transverse member 26 so that the member 26 can be used on racks having different front post distances. The opposite ends of the member 26 are provided by the respective free ends of the inner rods 48 and removably mounted on the front corner posts by means of suitable brackets respectively. Each bracket has a first portion for engagement with the associated end of the transverse member 26 and a second portion for insertion into one of the openings of the associated front corner post. A typical example of such a bracket includes a T-hook, an S-hook or the like. FIG. 1 shows a T-hook 50 loosely engaged with each end of the transverse member 26 so as to be a built-in part of the display unit.

The rear transverse member 28 extends between the rear corner posts of the rack and is removably mounted at its opposite ends on the rear corner posts. The remainder of the rear member 28 is identical to the front member 26.

Spacer sleeves 52 are disposed on the transverse members 26 and 28 as best shown in FIGS. 1 and 2. They are located on the opposite sides of each track. These sleeves 52 are formed of flexible material such as plastic and have a substantially C-shaped cross section such that they snap fit around the transverse members 26 and 28. The sleeves 52 when fit on the members 26 and 28 have an outer diameter substantially greater than the diameter of the apertures 40 and 44. The sleeves 52 therefore function as spacers for maintaining a proper space between the tracks 88 and 90 as well as means for locking the tracks 88 and 90 at proper positions on the transverse members 26 and 28.

It should however be recognized that by using the sleeves of different lengths, the positions of the tracks 88 and 90 can be changed along the length of the transverse members and the space between the adjacent tracks can be adjusted to a desired size. It will also be readily understood that the number of the tracks on the transverse members 26 and 28 can be adjusted easily. To reduce the number of the tracks, some of the sleeves 52 are disengaged from the transverse members 26 and 28 and then the tracks of a desired number are removed from the members 26 and 28. To increase the number, on the other hand, one or more additional tracks similar to the above tracks are connected to the transverse members and then additional sleeves 52 are fit on the transverse members.

Each display unit described above is mounted on the rack by using the brackets 50. The openings 22 of the corner posts with which the brackets 50 are engaged are selected such that each of the front and rear transverse members 26 and 28 is held substantially horizontally while the rear transverse member 28 is supported at the position higher than the front transverse member 26. This arrangement permits the tracks 88 and 90 to be inclined downwardly toward their respective front ends. The angle of inclination of the tracks from the horizontal may be about 1 to 20 degrees, preferably about 2 to 18 degrees and most preferably about 8 to 10 degrees. The inclination of the tracks allows the bottles on the tracks to gravity feed to the front ends of the tracks as the leading bottles in each row successively are removed from the tracks.

The track 88 is provided with a stopper means 106 at its front end. The stopper means 106 is best shown in FIG. 1 wherein it includes a length of the track 88 adjacent to the front end. Such a length is upturned relative to the immediately preceding length of the track 88 to provide forwardly upwardly sloping portions 108 and 110 of the rails 112 and 114. When the leading bottles in the track 88 travel along the sloping portions, they are braked to a stop and presented for removal from the track 88. The upturned length of the track 88 may be formed integrally with the track 88 or it may be provided as a separate replaceable portion. Reference numeral 120 designates a C-shaped reinforcing flange provided at the front end of the track 88. The flange 120 is designed to increase the rigidity of the front end of the track 88. Such an reinforcing flange 120 can also be used to provide a billboard surface.

Figure 3:
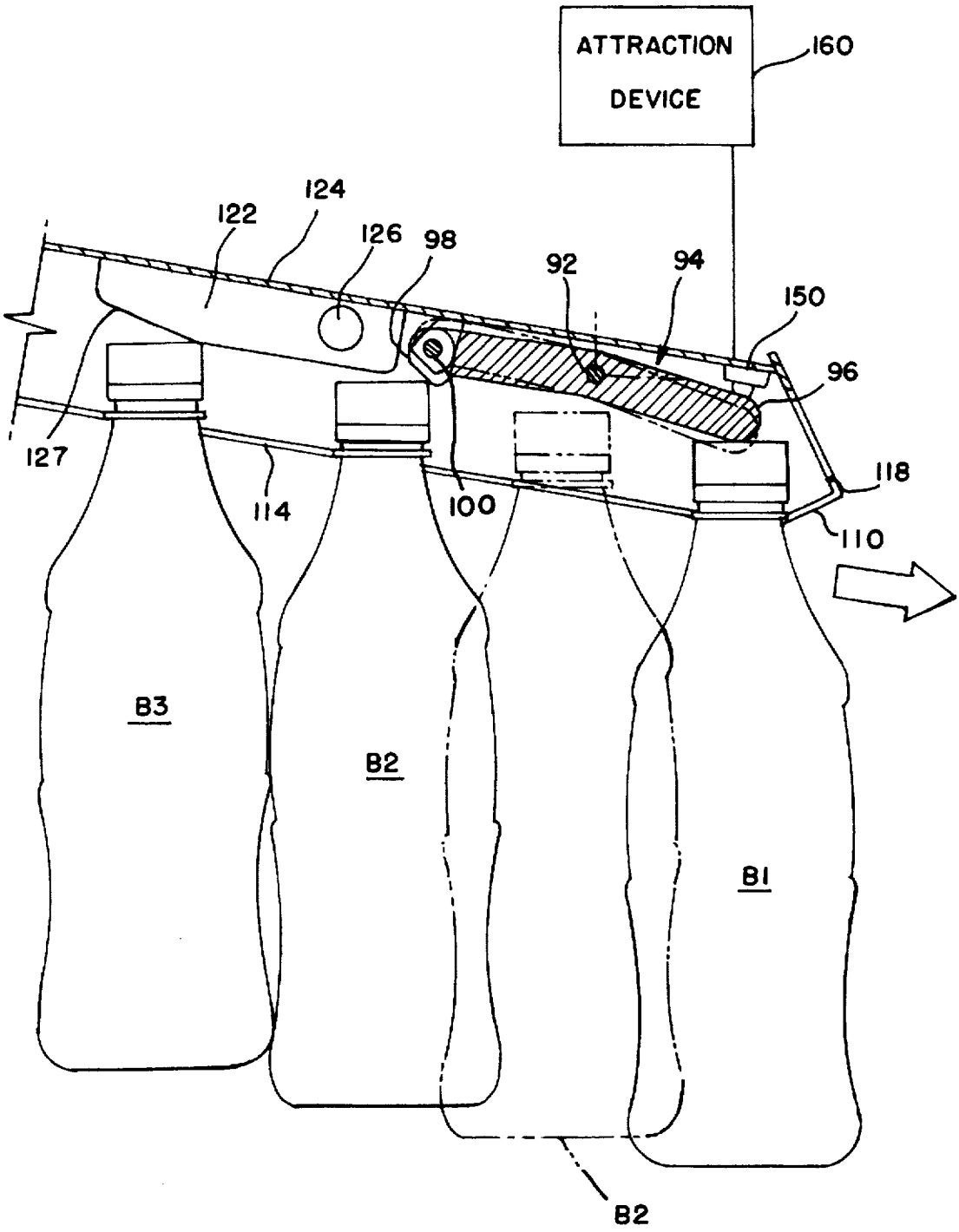
FIG. 3 is a fragmentary longitudinal section of one of the tracks in FIG. 1, showing the blocking position of the gate mechanism in the solid line and the unblocking position in the phantom line.
Figure 4:
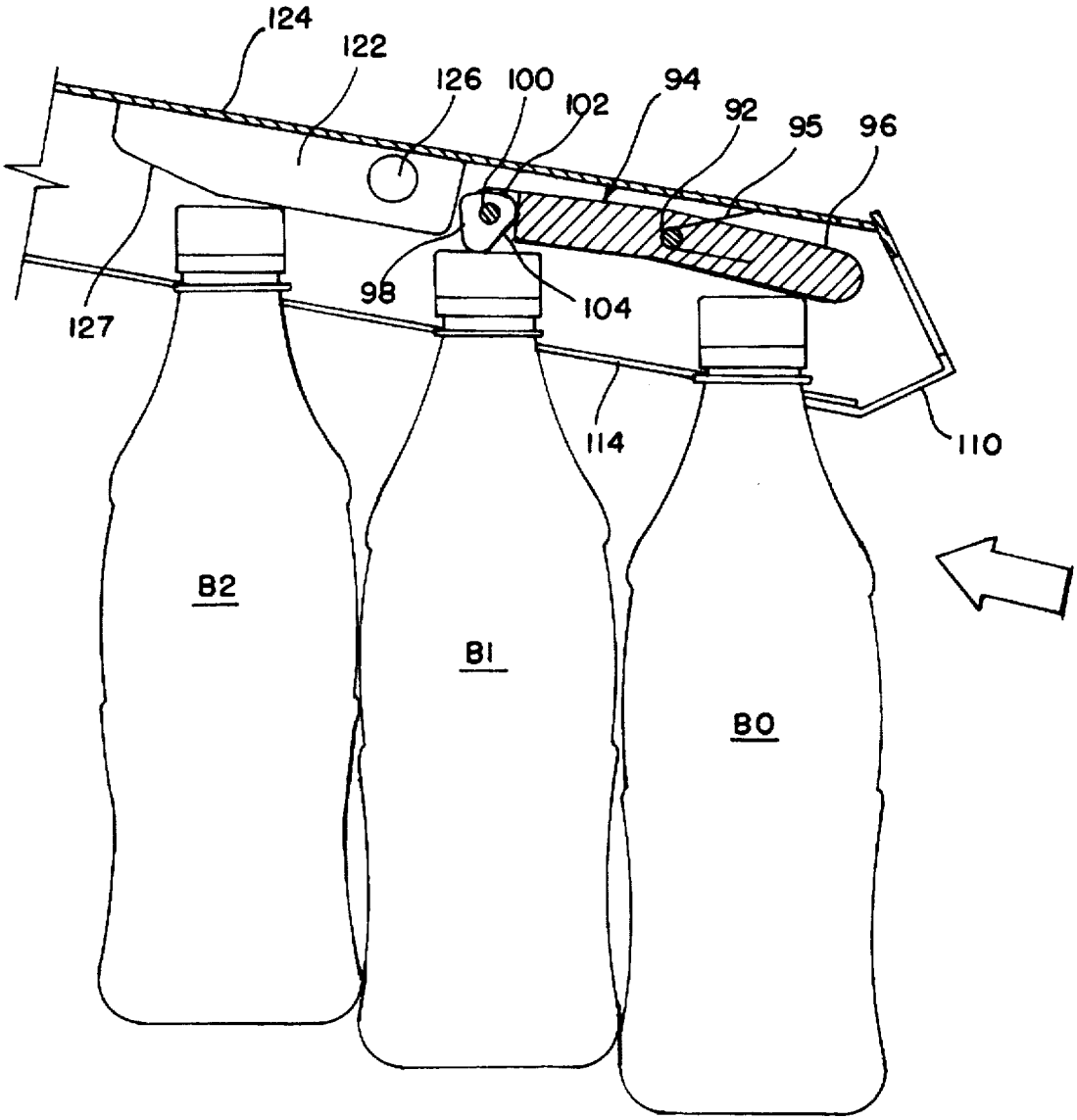
FIG. 4 is a view similar to FIG. 3, showing the latch in the inoperable position.

As shown in FIGS. 1, 3 and 4, a gate mechanism is provided at the location near the front end between the stopper means 106 and the rear end of the track 88. The mechanism comprises a pair of apertures 82 (only one shown in FIG. 1), a pivot 92, and a seesaw arm 94. The apertures 82 are formed respectively in the side walls 84 and 86 of the track 88. The pivot 92 extends transversely across each track and is received rotatably at the opposite ends thereof in the apertures 82. The seesaw arm 94 is disposed within and generally along each track.

The arm 94 includes a front lever 96 secured at an intermediate position thereof to the pivot 92 and a rear latch 98 pivotally connected to the rear end of the lever 96 by an auxiliary pivot 100. The arm 94 is pivotable about the pivot 92 between the blocking position as shown by the solid line in FIG. 3 and the unblocking positions as shown by the phantom line in FIG. 3. The latch 98 is connected to the lever 96 such that it is locked against its forward pivotal movement beyond the position shown in FIG. 3 while permitting its backward pivotal movement to and even beyond the position shown in FIG. 4. The position of the latch 98 as in FIG. 3 will hereinafter be referred to as "operable position" whereas the position of the latch 98 as in FIG. 4 will hereinafter be referred to as "inoperable position". The arm 94 is urged by a suitable means such as the gravity or a spring 95 (shown in FIG. 4) to the unblocking position whereas the latch 98 is normally retained in the operable position by the gravity. It should however be readily understood that the arm 94 may be urged to the blocking position by the gravity.

The lever 96 and the latch 98 are formed preferably of metal. As best shown in FIG. 4, the lever 96 has the shape of a slightly downwardly curved or bent bar rather than a straight bar, which includes a bifurcated rear end in which the latch 98 is pivotally received. The latch 98 has a rounded front surface 102 for permitting its pivotal movement relative to the lever 96 and a flat lower front surface 104 for abutting the rear end face of the lever 96. The flat surface 104 restrict forward pivotal movement of the latch 98 beyond the position as shown in FIG. 3. The lower surface of the latch 98 is also rounded to minimize the contact between the latch 98 and a bottle which moves immediately under the latch 98.

Reference numeral 122 designates a ceiling member which is struck from the top wall 124 of the track 88 and folded ninety degrees down into the track 88. The ceiling member 122 provides a guide for bottles and functions particularly to prevent the second leading bottles from being tilted excessively. The function of the ceiling member 122 will be described in more details later. The ceiling member 122 is provided with an aperture 126 for receiving the transverse member 26 and with a guide surface 127 sloping forwardly and downwardly. Reference numeral 128 is a channel member mounted on the track 90 to reinforce the area of the track 90 where the ceiling member 122 is struck.

The above merchandising device can be either front-loaded or back-loaded.

When bottles are loaded through the rear end of the track 88, the leading bottle in the track 88 is first captured by the stopper means 106 and pushes the arm 94 up to pivot it to the blocking position as depicted by the solid line in FIG. 3, where the forward end of the arm 94 is positioned outside the bottle pathway and the backward end is inside. The arm 94 in the blocking position causes the second leading bottle B2 to be captured by the latch 98. The captured bottle B2 bears pressure of other bottles there behind and thereby the leading bottle Bi is left alone at the front end of the track 88. More specifically, the arm 94 in the blocking position separates the leading bottle B1 apart from all the following bottles such as B2 and B3, and as a result, the leading bottle B1 is kept free of pressure of the bottles behind it and thus is disposed substantially vertical.

The second leading bottle B2 when captured by the latch 98 tends to be disposed at the position shown in FIG. 3 in a forwardly tilted condition as it bears pressure of other bottles. The cap of such a tilted bottle B2 abuts the ceiling member 122 and thereby the bottle B2 is restrained from excessive forward tilting. Excessive tilting would increase the chance that the bottles are jammed under the latch 98.

When the bottle B1 is removed from the track 88, the arm 94 is brought to the unblocking position where the forward end of the arm 94 is inside the pathway and the backward end is outside. This releases the next leading bottle B2 so that it slides down along the track 88 toward the front end thereof as illustrated by the phantom line in FIG. 3. At the front end, the bottle B2 pushes the arm 94 back to the blocking position so that the third leading bottle B3 is captured by the latch 98.

This device can also be front-loaded owing to the latch 98. When new bottles are front loaded, the latch 98 is pivoted to the inoperable position as shown in FIG. 4. More particularly, pushing the bottle B1 backward against the latch 98 while the arm 94 is in the blocking position causes backward pivotal movement of the latch 98. This in turn defines a space under the latch 98 as shown in FIG. 4 large enough to allow the bottles B1 and B0 to move backward therethrough.

In accordance with a feature of the invention, the above merchandising device has incorporated therein an attraction device and a sensor for controlling the operation of the attraction device.

In the illustrated embodiment, as shown in FIGS. 2 and 3, a sensor in the form of a mechanical switch 150 is mounted on one or more tracks such as the track 88 of the merchandising device. The switch 150 is removably secured to the lower surface of the top wall 124 by suitable retaining means such as a plastic or metal bracket/clip (not shown). The retaining means is secured to the track 88 by an adhesive or a fastener such as a rivet. The switch is in snap-engagement with the retaining means so as to be removable from the retaining means and to thereby facilitate the maintenance of the switch.

One preferred location of the switch 150 is a position directly above the seesaw arm 94 near its forward end as best shown in FIG. 3. The location of the switch relative to the arm 94 is adjusted such that when the arm 94 is in the blocking position, the switch 150 is pressed by the forward end of the arm 94 and when the arm 94 is brought to the unblocking position, the switch is released.

For use in the above-described location, a switch that is turned on when released is preferred. An example of such a switch is a lever type switch with activation in the "OPEN" position, which is commercially available from DUCO Technology located 2501 Green Valley Parkway, Suite 118-D, Henderson, Nev. 89014.

The above switch 150 is electrically connected to the attraction device 160 so that the device 160 is activated to start performing an attention-attracting activity when the switch 150 is turned on. The device 160 is controlled such that once activated, it continues its activity for a predetermined amount of time even after the switch 150 is turned off. The device 160 may be located on the merchandising device to form a singular unit with the merchandising device. Alternatively, it may be located off the merchandising device at a position over, beside or remote therefrom.

In the above arrangement, the attraction device 160 is activated every time a leading bottle is removed from the track 88. However, the attraction device 160 may be arranged so that it is activated only once while two, three, four, five or more leading bottles are removed. Such an arrangement is effective in preventing too frequent activation.

The attraction device 160 useful in the invention includes, but is not limited to, a sound generator, a light emitter, a scent emitter and/or a mechanical movement device.

The sound generator is a device that generates a pre-recorded sound upon activation. An example of the sound generator includes a cassette tape player, a CD player or a voice chip device. A typical voice chip device may be located in a small space such as between any two adjacent tracks. An example of the voice chip device useful in the invention is a 12-SECOND CUSTOM AUDIO UNIT and a VS-300 circuit board, both commercially available from DUCO Technology the location of which is mentioned above.

Any sound may be pre-recorded in the sound generator to be ready to play upon installation of the merchandising device. Alternatively, desired sound may be recorded after installation. An example of the recorded sound includes, but is not limited to, music, sound effect and/or a promotional message. Two or more different kinds of sound may be recorded so that they can be randomly played one at a time.

The light emitter is a device that emits visible light when activated. An example of the light emitter includes a LCD with a backlighting, or a LED or light valve device in which LEDs or light valves are controlled to be capable of blinking. In the LED or light valve device, plural LEDs or light valves are arranged to create flashing illuminations of any shape and color. LEDs or light valves may be located, for example, on the front surface such as the flange(s) 120 of one or more tracks, on the back wall of a gondola-type support rack or on a separate illumination board, whereas a display panel type light emitter may be used as a header device located on top of the merchandising device. An example of a LED device is a 9-LED RANDOM FLASH HARNESS commercially available from DUCO Technology.

The scent emitter is an apparatus that emit scent, aroma or fragrance upon activation. The scent emitter may be comprised of a liquid perfume/air-freshening agent container, an air pump device connected to the container, and a spraying nozzle attached to the pump device. Alternatively, it may be comprised of a heat-activated perfume supply station provided with a heating element and a fan. Such a scent emitter may be effective in promoting food or cosmetic product. For example, the scent emitter may be controlled by two or more switches mounted on different tracks to emit different types of aroma or scent respectively matching two or more food or cosmetic products removed from the different tracks.

The mechanical movement device is a device which performs humorous, interesting, amusing, surprising and/or pleasing movement when activated. An example of the mechanical movement device includes a mechanical puppet device (e.g. a jack-in-the-box device), a rotary logo wheel viewed in a window, a mini merry-go-round device or the like. Typically, the mechanical movement device is placed beside or on top of the merchandising device.

Figure 5:
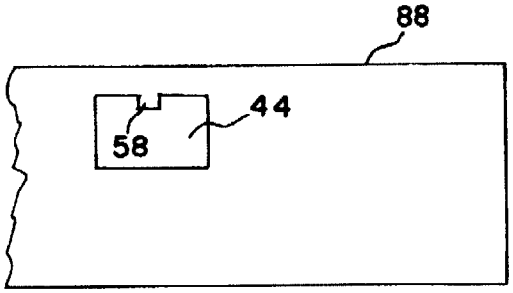
FIG. 5 is a fragmentary side elevation of a modified form of one of the tracks in FIG. 1, showing a rectangular aperture for receiving a modified transverse member.
Figure 6:
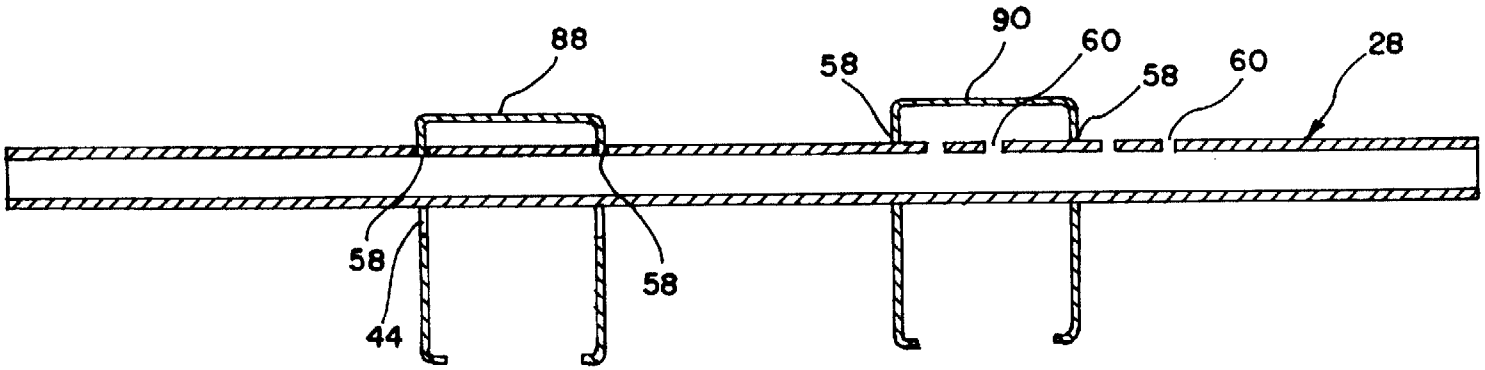
FIG. 6 is a longitudinal section of a transverse support member provided with alternative track-locking means including a plurality of openings in the transverse member.

It will be recognized that many variations may be made to the foregoing within the scope of the present invention. For example, instead of using the sleeves 52, recesses or openings may be formed along the transverse members 26 and 28, and a small tab may be formed at the perimeter of each of the apertures 40 and 44 to be received in the openings. An example of such a tab-and-opening arrangement is shown in FIGS. 5 and 6 in which the aperture 44 of the track 88 is shown rectangular in shape, and a tab 58 is projecting downwardly from the perimeter of the aperture 44. In FIG. 6, the transverse member 28 is shown as a tubular member of a rectangular cross section, and is provided at its upper wall with openings 60 for receiving the tabs 58. By inserting the tabs 58 into the openings, the tracks can be locked in proper positions on the transverse members 26 and 28.

It should be further recognized that the ceiling member 122 may be replaced with a separate guide piece secured to the inside surface of the track 88. Such a separate ceiling member is preferably formed of low friction material and more preferably of plastic having a lubricant agent dispersed therein. Although in FIG. 3, the front end of the ceiling member 122 is longitudinally spaced from the latch 98, the ceiling member 122 or the separate guide piece may be extended forward such that it overlaps the latch 98.

Figure 7:
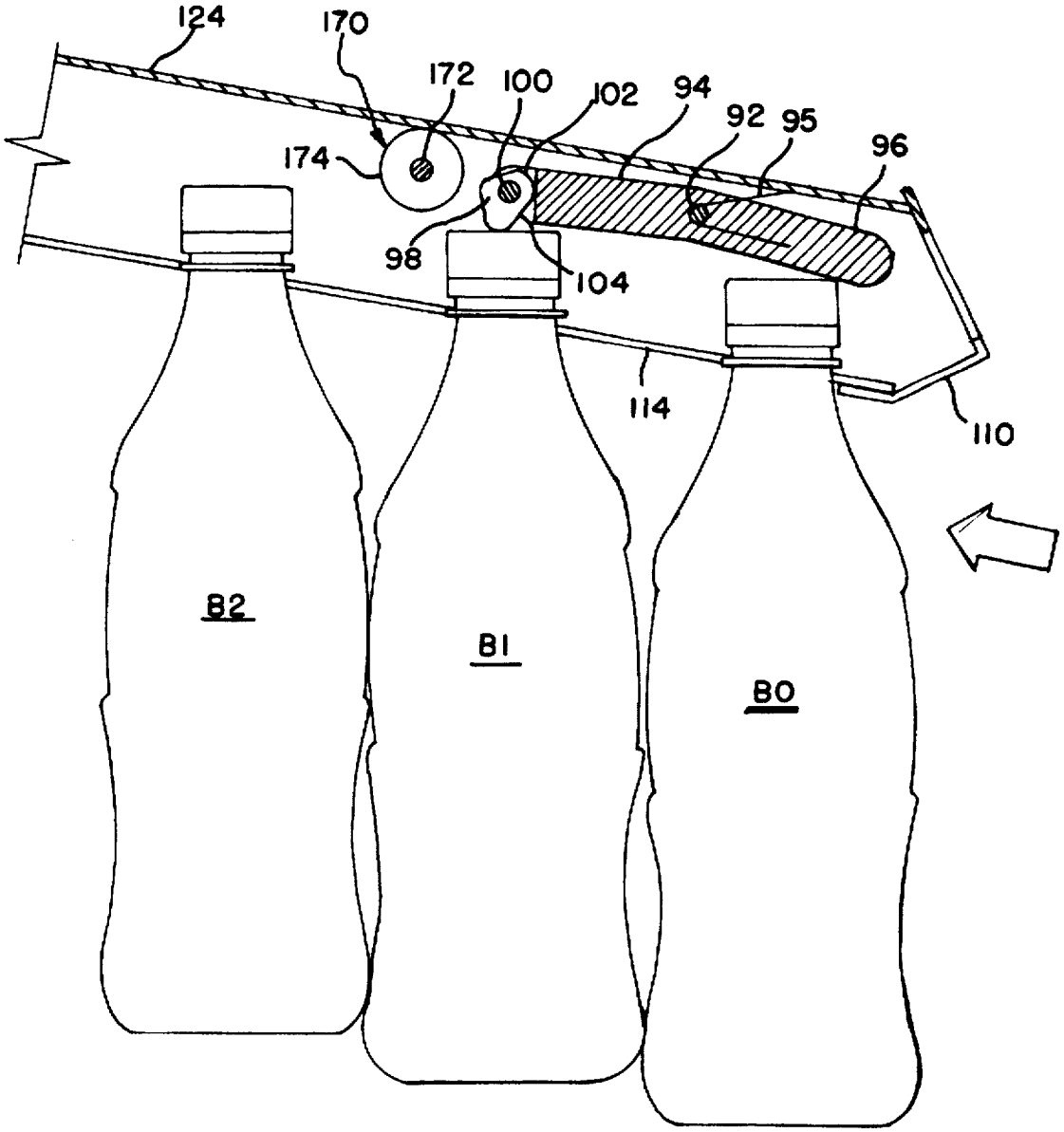
FIG. 7 is a fragmentary longitudinal section of a modified form of the track shown in FIG. 4.

Alternatively, the ceiling member 122 may be replaced with a roller assembly 170 such as shown in FIG. 7. A preferred roller assembly includes a pin 172 extending between the side walls 84 and 86 of the track 88 and a pair of rollers 174 (only one shown in FIG. 7) rotatably supported on the pin 172. The rollers 174 are disposed side by side on the pin 172 with a space therebetween, and thus the assembly 170 can accommodate the latch 98 in such a space even though it is located immediately behind or in an overlapping relationship with the arm 94. The roller assembly 170 functions in a manner similar to the ceiling member 122, and provides a guide for bottles to prevent the second leading bottles from being tilted excessively. In other words, the roller assembly 170 decreases the chance that the bottles are jammed under the latch 98.

It will be further recognized that the position and type of the switch is not limited to that shown in FIGS. 2 and 3. For example, a switch that is turned on when pressed may be located right above the backward end of the seesaw arm 94. Alternatively, a switch with an actuation lever projecting into the bottle pathway may be located on the track side/top wall so that it is directly contacted and operated by any one of the bottles on the track 88. A rotary switch may be employed instead of the lever switch and may be connected to the pivot 92 for direct operation by pivotal movement of the arm 94.

It will be further recognized that any conventional sensor other than mechanical sensors and that is capable of detecting movement of an article may be used in the invention. Such a sensor include an optical sensor, a motion sensor and the like. Either a optical sensor or a motion sensor is located at a suitable position on the merchandising device and transmits, upon detecting bottle movement, an electric signal to the attraction device 160 to activate it. A preferred location of an optical sensor is a position where the sensor can detect movement of the seesaw arm 94. Such a position may be on either side wall 84 or 86 near the front end of the track 88. A motion sensor is mounted preferably on the seesaw arm 94 and more preferably at either end thereof.

Figure 8:
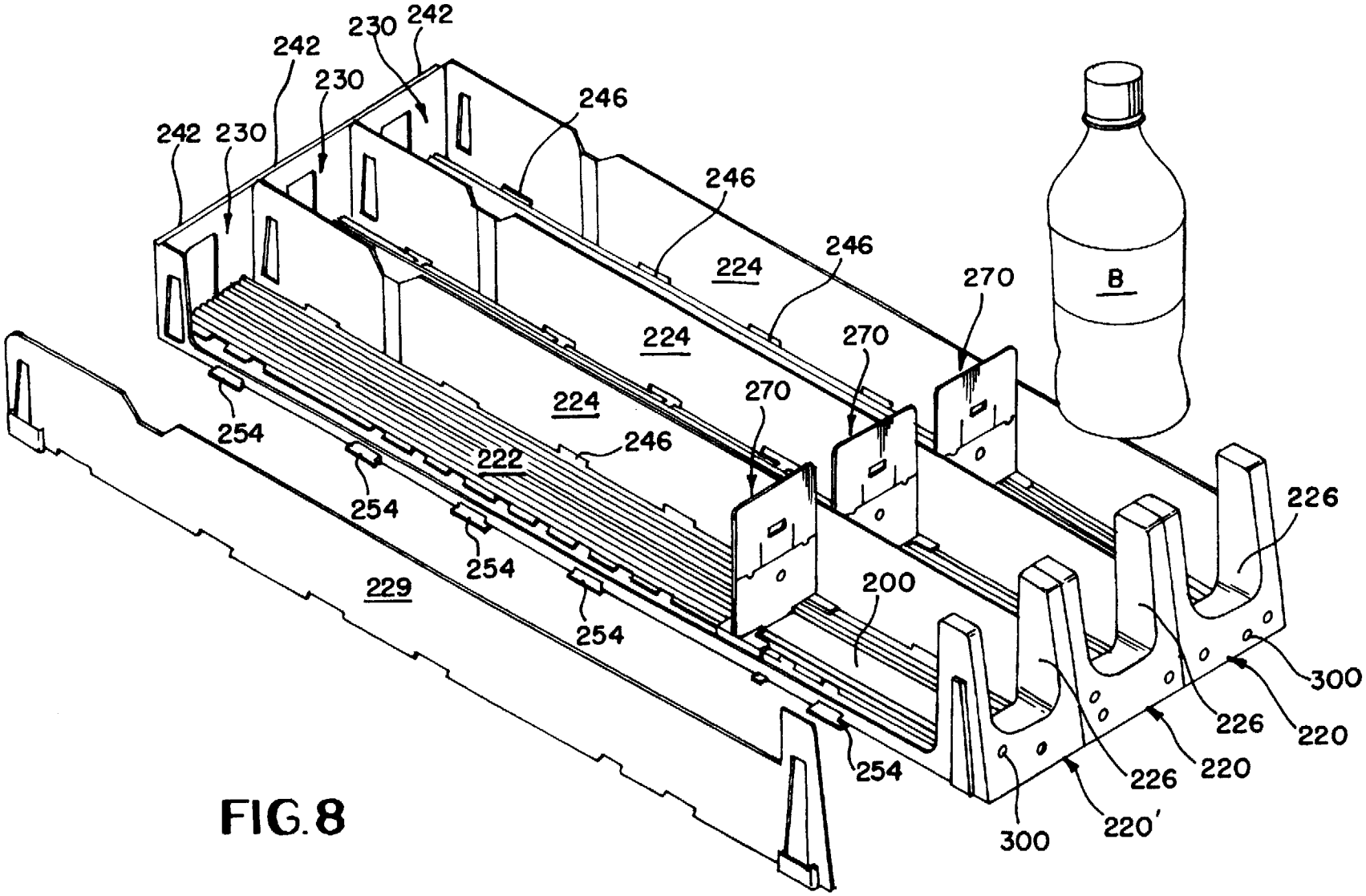
FIG. 8 is a perspective view of a second embodiment of the merchandising device according to the present invention.
Figure 9:
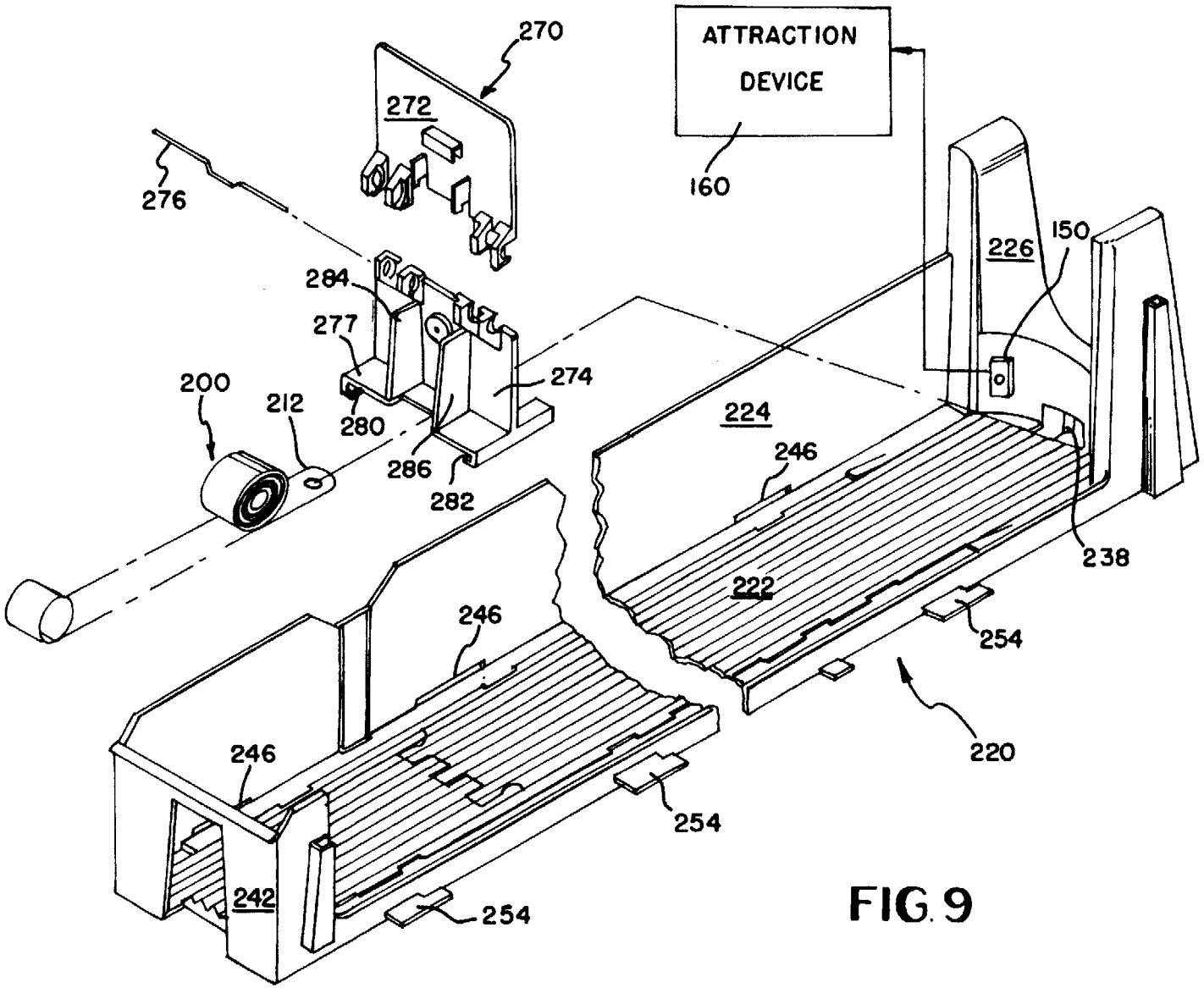
FIG. 9 is a perspective view of one of the tracks in FIG. 8.

FIGS. 8 and 9 illustrates a second embodiment of a merchandising display device according to the invention, in which the attraction device 160 and the switch 150 cooperate with a spring-loaded chute type display device. The display device includes a plurality of parallel elongate tracks 220 and 220' connected together by means of locking tabs 254 and slots 246. Each track comprises a floor 222 for positioning articles B (e.g., bottles, cans or the like) thereon, and a side wall 224 formed along one of the side edges of the floor 222 and upstanding from the floor 222.

When the tracks 220 and 220' are connected together, the side wall 224 of each track is shared by two adjacent tracks to function as a common side wall of both the adjacent tracks. As a result, in an assembled condition, each track is provided with a pair of spaced parallel side walls 224 as shown in FIG. 8. The endmost track 220' is adjoined by no other track, and for this reason, a separate side wall member 229 is connected along the free side edge of the endmost track 220' to make the track 220' complete. Each complete track is of a channel structure in which articles are received and supported for sliding movement on the floor 222 along the pathway 230 defined within the channel structure.

Each track 220 or 220' is also provided at its front end with a front wall 226 and at its rear end with a rear wall 242. The front wall 226 is upstanding from the floor 222 so as to close a front opening of the respective track and to thereby function as a stopper means for engaging the leading articles on the track.

A pusher plate 270 is slidably connected to the floor 222 for movement along the track. The pusher plate 270 shown in FIG. 9 is of a three-piece structure comprising a base portion 277 having an opposite engaging hooks 280 and 282 for sliding engagement with the floor 222, a lower panel portion 274 integrally formed with and upstanding from the base portion 277, and an upper panel portion 272 pivotally connected to the lower panel portion 274 through a pin 276. The pusher plate 270 is urged toward the front wall 226 by means of a coiled flat plate spring 200. The forward end of the spring 212 is secured to the front wall 226 by an anchor 238 whereas the coiled portion is held on the rear side of the pusher plate 270 at the position between ribs 284 and 286. Articles arranged in a row are positioned between the pusher plate 270 and the front wall 226, and are thus moved forward by spring load as the leading articles are removed successively from the track.

As shown in FIG. 9, the switch 150 is mounted on the front wall 226 of at least one of the tracks 220 and 220' so as to face the rear wall 242. At this location, the switch 150 is pressed directly by the leading articles as they arrive at the front wall 226 and it is released by the leading bottles when they are removed from the track. The attraction device 160 is electrically connected to the switch and thus is triggered by movement of the leading articles.

When the attraction device 160 is a light emitter including LEDs, the LEDs may be mounted on the front surface of the front walls 226 as indicated by the reference numeral 300.

It will be recognized that the above described spring-loaded device may be converted into a gravity feed device by removing the pusher plate 270 and the spring 200 and substitute therefor a support structure such as a wedge shaped base that is capable of supporting the assembled tracks such that the tracks are inclined downwardly toward their front ends.

It will be further recognized that present invention may be used with most of conventional forward feed display devices other than the devices described above. Such conventional devices include those disclosed in U.S. Pat. Nos. 4,318,485; 4,367,818; 4,401,221; 4,239,099; 4,314,648; 4,496,037; 4,690,287; 4,303,162; 4,730,741; 4,762,236; 4,898,282; 5,069,349; and 5,111,942 which are hereby incorporated by reference.

What is claimed is:

1. A merchandising device for displaying and dispensing articles, comprising:

a track having a front end and a rear end and defining a pathway therealong to support a row of articles such that said articles are movable along said pathway and are removable from said pathway via said front end;

means for feeding said articles toward said front end as a leading article in said row is removed from said pathway;

stopper means provided at said front end of said track for engagement with said leading article so as to prevent said leading article from being accidentally removed via said front end whereby said leading article when arriving at said front end is stopped and presented for removal from said pathway;

an attraction device for performing an attention-attracting activity; and a sensor for detecting movement of said articles in said row, said sensor being connected to said attraction device so as to trigger said activity upon detection of movement of said articles.

2. The merchandising device according to claim 1, wherein said sensor is mounted on said track adjacent said front end so as to trigger said activity upon detection of removal of said leading articles from said pathway.

3. The merchandising device according to claim 1, wherein said sensor comprises a mechanical switch positioned to be operated by movement of said article.

4. The merchandising device according to claim 1, wherein said sensor comprises an optical sensor mounted on said track.

5. The merchandising device according to claim 1, wherein said sensor comprises a motion sensor.

6. The merchandising device according to claim 3, wherein said switch is located for operation by direct contact with said leading article such that said switch is turned off by said leading article upon arrival thereof at said front end and is turned on by said leading article upon removal thereof from said pathway.

7. The merchandising device according to claim 3, further comprising a gate mechanism for blocking said pathway in response to arrival of said leading article at said front end such that forward movement of the other articles in said row is blocked by said gate mechanism and for unblocking said pathway in response to removal of said leading article from said pathway, said switch being located for operation by said gate mechanism such that said switch is turned off in response to blocking action of said gate mechanism and is turned on in response to unblocking action of said gate mechanism.

8. The merchandising device according to claim 1, wherein said feeding means comprises a support structure for supporting said track such that said track is inclined downwardly toward said front end whereby said articles are allowed to gravity feed toward said front end as said leading article is removed from said pathway.

9. The merchandising device according to claim 1, wherein said feeding means comprises a pusher movably connected to said track for movement along said pathway and having a front side for engagement with a rearmost article in said row, and a spring for urging said pusher toward said front end so as to move all articles in said row toward said front end.

10. The merchandising device according to claim 7, wherein each of said articles has a neck and a integrally formed annular neck flange, and said track comprises a pair of substantially parallel rails extending along said pathway so as to suspend said articles by said neck flanges for movement along said pathway, said rails being spaced apart to receive therebetween said necks of said articles such that said articles are slidably engaged at underside of said neck flanges with said rails.

11. The merchandising device according to claim 10, wherein said stopper means comprises a length of said track adjacent to said front end, said length being upturned relative to an immediately preceding length of said track to provide a forwardly upwardly sloping section along which said leading article travels so that said leading article is braked to a stop and presented for removal from said pathway.

12. The merchandising device according to claim 10, wherein said gate mechanism comprises a seesaw arm pivotally connected to said track for upward and downward movement, and said switch is positioned for operation by said seesaw arm.

13. The merchandising device according to claim 1, wherein said track comprises a floor for positioning said articles thereon for movement therealong, and a pair of spaced parallel side walls upstanding from said floor to form in cooperation with said floor a channel structure having a U-shaped cross section, said stopper means comprises a front wall upstanding from said floor at said front end of said track so as to close a front opening of said track, and said sensor comprises a mechanical switch mounted on said front wall to be operated by said leading article.

14. The merchandising device according to claim 1, wherein said attraction device comprises a sound generator.

15. The merchandising device according to claim 1, wherein said attraction device comprises a light emitter.

16. The merchandising device according to claim 1, wherein said attraction device comprises a scent emitter.

17. The merchandising device according to claim 1, wherein said attraction device comprises a mechanical movement device.

* * * * *